US006439929B1

(12) United States Patent
Jenets

(10) Patent No.: US 6,439,929 B1
(45) **Date of Patent: *Aug. 27, 2002**

(54) BRAIDED SHIELD TERMINATING POTTING BACKSHELL

(75) Inventor: Robert J. Jenets, North Huntingdon, PA (US)

(73) Assignee: Westinghouse Air Brake Technologies, Wilmerding, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/539,180

(22) Filed: Mar. 30, 2000

(51) Int. Cl.[7] ..... H01R 9/03
(52) U.S. Cl. ..... 439/610; 439/276
(58) Field of Search ..... 439/610, 607, 439/581, 276

(56) References Cited

U.S. PATENT DOCUMENTS 3,805,218 A * 4/1974 Voida ..... 439/610
3,944,317 A * 3/1976 Oberdiear ..... 439/610
3,990,765 A * 11/1976 Hill ..... 439/610
4,399,318 A * 8/1983 Waters ..... 174/35 C
5,052,947 A * 10/1991 Brodie et al. ..... 439/607
5,917,148 A * 6/1999 Woehl et al. ..... 174/35 C

* cited by examiner

*Primary Examiner*—Gary F. Paumen
*Assistant Examiner*—James Ray Harvey
(74) *Attorney, Agent, or Firm*—James Ray & Associates

(57) ABSTRACT

A terminating potting backshell for connecting a wire or wire harness to a mating receptacle of an electrical/electronic device which is in the form of a generally tubular electrically conductive body and having threads encircling a first end for attaching the backshell to a mating receptacle on the electrical/electronic device and also having a groove spaced from a second end over which a conductive tubular braided shield can be disposed. The groove adapted to receive a clamp for holding the tubular braided shield onto the second end of the backshell.

10 Claims, 1 Drawing Sheet

BRAIDED SHIELD TERMINATING POTTING BACKSHELL

FIELD OF THE INVENTION

The present invention relates, in general, to a terminating backshell and, more particularly, this invention relates to a new and improved terminating potting backshell to which braided shielding can be attached to provide a full 360° of wire shielding up to the backshell and further having a-relatively short profile which will facilitate such backshell's connection to a mating connector providing limited space adjacent thereto. In use, the backshell is intended to include a potting material to assure that any loose wire fibers from the braid shield do not contact any of the shielded wires, while the potting material also adds a degree of environmental protection and some strain relief to the soldered wire joints.

BACKGROUND OF THE INVENTION

Terminating backshells are generally well known in the electric and electronic arts as housings which cover and protect wire, cable and wire harness connections at a connector that is intended to be connected to a mating receptacle of an electric or electronic device. Often times, these terminating backshells are intended to be filled with a potting compound, such as at non-conductive epoxy or the like, which will protect soldered wire joints from the environment and to prevent corrosion, while at the same time providing some degree of strain relief to soldered wire joints.

In order to effectively shield the wires from EMI and RFI interference, it is common practice to provide the wires, cable or wire harness with a conductive shielding which most commonly comprises a flexible braided metal conductor through which the wire, cable or harness pass. However, simple circular potting backshells to which a braided woven tubular shielding can be attached for providing 360° of shielding are not available in a small enough profile to permit easy attachment of the backshell to a mating receptacle.

SUMMARY OF THE INVENTION

This invention is predicated on the conception and development of a new and improved terminating potting backshell adapted to receive a flexible braided metal conductor shield that will provide a full 360° of wire shielding and further has a profile short enough in length to permit a braided shield attached thereto to be bent to facilitate connection of the terminating backshell to a mating receptacle providing limited space adjacent thereto. That is to say, commercially available terminating backshells are rather large in profile which renders them rather difficult, if not impossible, to be connected to a mating receptacle where there may be limited space adjacent the mating receptacle.

OBJECTIVES OF THE INVENTION

Accordingly, it is one of the primary objects of the present invention to provide a new and improved braided shield terminating potting backshell.

Another object of the present invention is to provide a new and improved terminating backshell to which a braided shield can be attached to provide 360° of shielding around the wire, cable or wire harness connections within the backshell.

A further object of the present invention is to provide a new and improved terminating backshell to which a braided shield can be attached to provide 360° of shielding around the wire, cable or wire harness connections within the backshell and having a simple profile small enough to permit such backshell's substantially unobstructed attachment to a mating receptacle of an electrical or electronic device.

In addition to the several objects and advantages of the present invention which have been described in some detail above, various additional objectives and advantages of the instant invention will become more readily apparent to those persons who are skilled in the relevant electric/electronic arts from the following more detailed description of the invention, particularly, when such description is taken in conjunction with the attached drawing figures as described below as well as with the appended claims.

DESCRIPTION OF THE PREFERRED EMBODIMENT OF THE INVENTION

Figure 1:
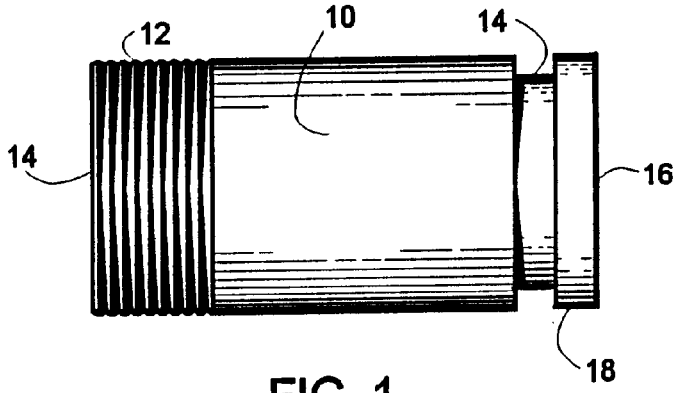
FIG. 1 is an elevational view of a presently preferred embodiment of the terminating potting backshell according to the invention.
Figure 2:
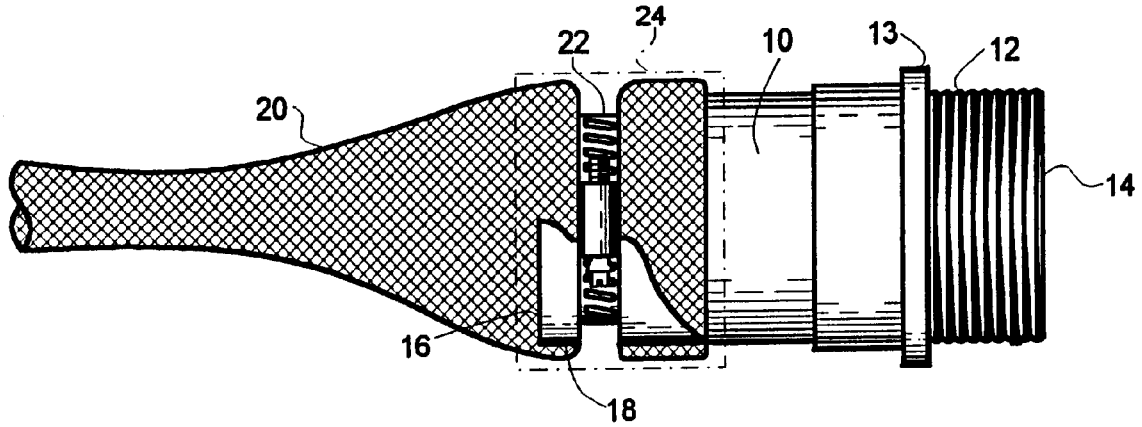
FIG. 2 is a side view of an alternative embodiment of a terminating potting backshell as it would appear in service when a braided shield is attached thereto.

Reference to FIGS. 1 and 2 will illustrate a presently preferred embodiment of the braided shield terminating potting backshell of this invention. Such backshell preferably comprises a generally tubular conductive body 10 having a threading 12 at a first end 14 thereof. Such threading 12 is provided for the purpose of attaching the backshell to a mating receptacle of an electric or electronic device (not shown). Obviously, the threading 12 could be female as well as male and should have parameters that will permit the backshell to be attached to a mating receptacle of an electric or electronic device.

At least one groove or channel 14 encircling the outer cylindrical surface of such tubular body 10 is spaced from the second end 16 of tubular body 10 at least sufficient to provide a rim or flange 18. As shown in the embodiment of FIG. 2, the tubular body 10 is provided with a flange 13 in order to facilitate manipulation of a manual connecting effort.

For service as intended, and as illustrated in FIG. 2, a wire, or wires, of a cable or wire harness (not shown) is/are soldered to one or more pins of a plug type connector (not shown) within the backshell and a potting material (not shown) is injected into the backshell which not only serves to insulate the wires from each other and from the backshell but also serves to relieve strain on the soldered wires. There are several well known potting materials available commercially, any one of which will suffice for the purposes of this invention.

For adequate protection from EMI and RFI emissions, a braided shield 20 is slipped over the wires such that the end of the braided shield 20, encasing the wire or wires, is disposed over the end of tubular body 10 as well as disposed over groove 14 and flange 18. A clamp 22 is then clamped within such groove 14 with the braided shield 20 thereunder, as is shown in FIG. 2. In the alternative embodiment to a clamp 22, a shrink tube 24 may be utilized to hold the braided shield 20 onto the second end 16 of the tubular body 10.

Figure 3:
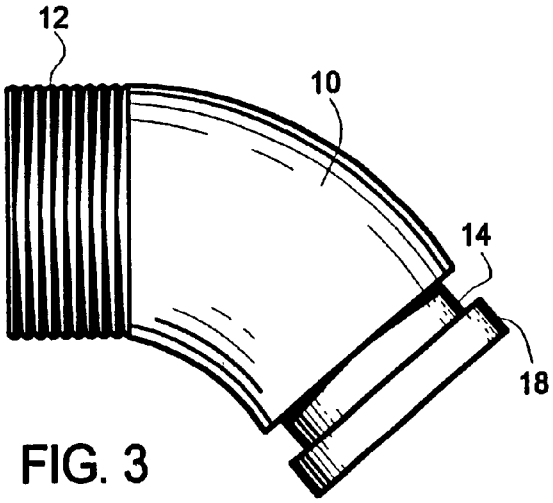
FIGS. 3 and 4 illustrate other alternative embodiments of a terminating backshell which is indicative of the various shapes and forms in which the backshell can be provided.
Figure 4:
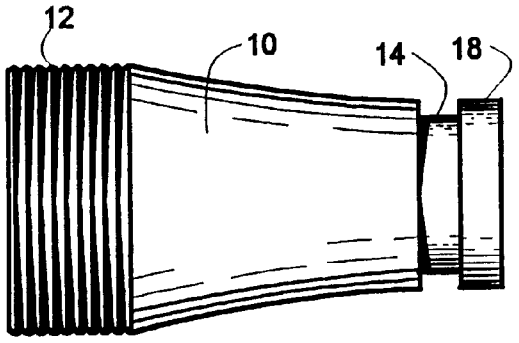

While the use of a simple tubular embodiment of the backshell of the present invention has been disclosed, it should be apparent that modifications or other features could be incorporated therein without departing from the spirit of the invention. For example, while the backshell itself is shown, in FIGS. 1 and 2, to be of a cylindrical tubular form, obviously other forms and shapes could be utilized such as an elbow form, as shown in FIG. 3, or a tubular form having different diameters at each end thereof, as shown in FIG. 4.

In addition, the groove 14 could be provided in any of a number of different cross-sectional forms. While the groove 14 is shown in FIGS. 1 and 2 to have a rectangular cross-section, it should be apparent that other cross-sectional forms could be utilized in combination with a variety of different cross-sectional forms for the clamp 22, keeping in mind that all that is necessary is for clamp 22 to press an end of the braided shield 20 into groove 14 so that it is securely attached thereto to provide a permanent shield around the wires joined within tubular body 10.

I claim:

1. A terminating potting backshell for connecting at least one conductor to a mating receptacle of an electrical/electronic device, said backshell comprising, a generally hollow, electrically conductive body having predetermined dimensions and open at each of two ends, threads encircling at least a portion of a first end for attaching said backshell to such mating receptacle on such electrical/electronic device, a groove having a predetermined cross-section, spaced closely adjacent a second end over which an end of a conductive braided shield can be disposed, and an adjustable clamp matingly engageable with an outer surface of said conductive braided shield for compressing said end of said conductive braided shield into said groove to hold said end of said braided shield onto said second end of said backshell, said clamp having a width substantially equal to a width of said groove such that said clamp and said braided cable enter said groove.

2. A terminating potting backshell, according to claim 1, in which said electrically conductive body is generally a cylindrical tubular body.

3. A terminating potting backshell, according to claim 2, in which said cylindrical tubular body is provided with a different diameter at each end thereof.

4. A terminating potting backshell, according to claim 2, in which said cylindrical tubular body is shaped substantially as an elbow.

5. A terminating potting backshell, according to claim 1, in which said groove has a substantially rectangular cross-section adapted to receive a clamp having a mating substantially rectangular cross-section.

6. A connection with an electric/electronic device comprising a backshell which encases at least one conductor connected to a connector, a non-conductive, substantially non-porous potting material disposed within said backshell, a braided conductive shield encasing said at least one conductor having an end connected to said backshell, threads encircling a first end of said tubular backshell for attaching said backshell to a mating receptacle on said electrical/electronic device and means engageable with an external surface of an end of said braided conductive shield for connecting said end of said braided conductive shield to a second end of said backshell, said means having a width substantially equal to a width of said groove such that said means and said braided cable enter said groove.

7. A connection, according to claim 6, in which said means for connecting said braided conductive shield to said second end of said backshell comprises a groove around a periphery of said backshell spaced from said second end over which said conductive braided shield is disposed and a clamp disposed around said conductive braided shield which compresses an end of said shield into said groove.

8. A connection, according to claim 7, in which said clamp comprises a shrink tube.

9. A connection according, to claim 7, in which said braided conductive shield is substantially tubular in form.

10. A connection, according to claim 7, in which said groove is generally rectangular in cross-section and said clamp has a mating generally rectangular cross-section.

* * * * *